US011166505B2

(12) United States Patent
Gonzalez

(10) Patent No.: US 11,166,505 B2
(45) Date of Patent: Nov. 9, 2021

(54) HIDDEN TROUSER SUSPENSION APPARATUS

(71) Applicant: Robin Gonzalez, Miami, FL (US)

(72) Inventor: Robin Gonzalez, Miami, FL (US)

( * ) Notice: Subject to any disclaimer, the term of this patent is extended or adjusted under 35 U.S.C. 154(b) by 0 days.

(21) Appl. No.: 17/054,335

(22) PCT Filed: May 10, 2019

(86) PCT No.: PCT/US2019/031787

§ 371 (c)(1),
(2) Date: Nov. 10, 2020

(87) PCT Pub. No.: WO2019/217862

PCT Pub. Date: Nov. 14, 2019

(65) Prior Publication Data

US 2021/0161232 A1 Jun. 3, 2021

Related U.S. Application Data

(60) Provisional application No. 62/669,982, filed on May 10, 2018.

(51) Int. Cl.
*A41F 5/00* (2006.01)
*A41F 3/02* (2006.01)

(52) U.S. Cl.
CPC . *A41F 5/00* (2013.01); *A41F 3/02* (2013.01)

(58) Field of Classification Search
CPC ..... A41F 5/00; A41F 3/02; Y10T 24/44043; Y10T 24/4051
See application file for complete search history.

(56) References Cited

U.S. PATENT DOCUMENTS 2,001,629 A * 5/1935 Quasso ..... A41F 5/00 24/342.1
7,398,558 B1 * 7/2008 Kattenhorn ..... A41F 5/00 2/79
9,370,213 B1 6/2016 Dighton et al.
(Continued)

FOREIGN PATENT DOCUMENTS

JP 07331517 A 12/1995
JP 2012132116 A 7/2012

*Primary Examiner* — Robert Sandy
(74) *Attorney, Agent, or Firm* — The Keys Law Firm PLLC

(57) ABSTRACT

A hidden trouser suspension apparatus which is worn in a concealed manner and operates to assist in effectively holding up a wearer's trousers. The hidden trouser suspension apparatus includes a holder having a rigid portion formed of a substantially planar body and an engager having a rigid, substantially planar body. The engager, when secured underneath a wearer's trousers behind a wearer's belt in the trousers, is structured to protrude into the inside surface of the trousers and provide a surface on which a belt looped in the trousers can rest. The holder and engager structured to be releasably fastened together with a front surface of the holder flush with a corresponding back surface of the engager through the operation of the positioning mechanism and the locking mechanism in a manner which fixes the holder and engager, when sandwiched around a portion of a shirt, in place on the shirt.

20 Claims, 9 Drawing Sheets

(56) References Cited

U.S. PATENT DOCUMENTS

| | | | | |
|---|---|---|---|---|
| 2014/0150167 | A1* | 6/2014 | Mowad | A41F 19/00 2/337 |
| 2015/0201689 | A1 | 7/2015 | Halbert | |
| 2016/0128407 | A1* | 5/2016 | Kim | A41F 3/02 2/340 |

* cited by examiner

Fig. 16
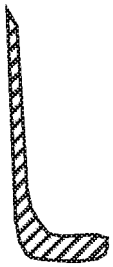
Fig. 17
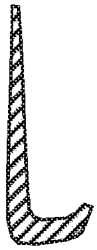
Fig. 18
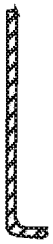
Fig. 19
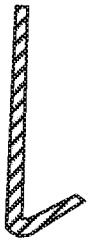
Fig. 20
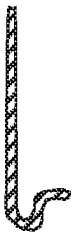
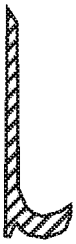
Fig. 21
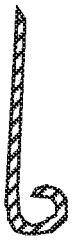
Fig. 22
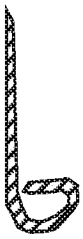
Fig. 23
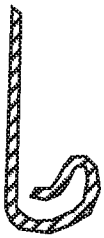
Fig. 24
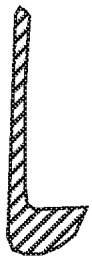
Fig. 25
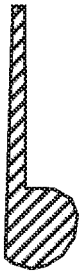
Fig. 26
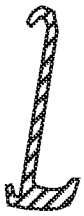
Fig. 27
Fig. 28
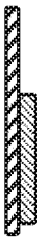
Fig. 29
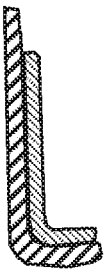
Fig. 30
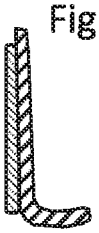
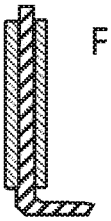
Fig. 31

Fig. 37
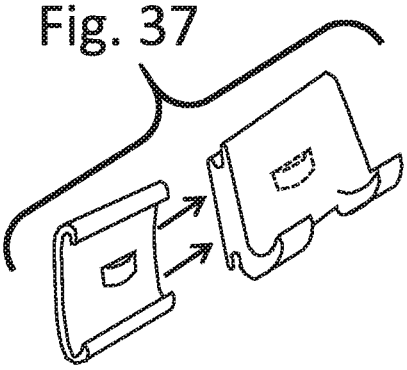
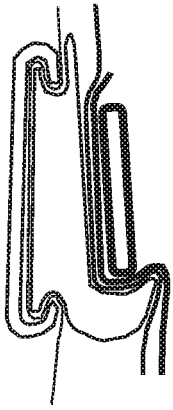
Fig. 38
Fig. 39
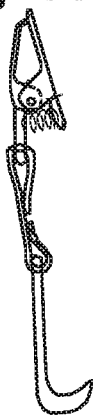
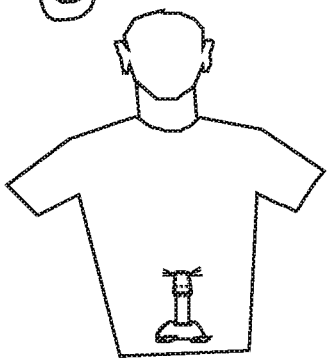
Fig. 40
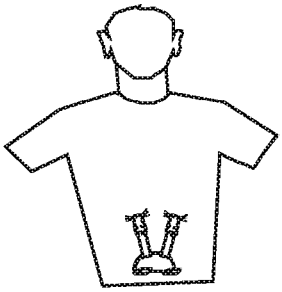
Fig. 41
Fig. 42
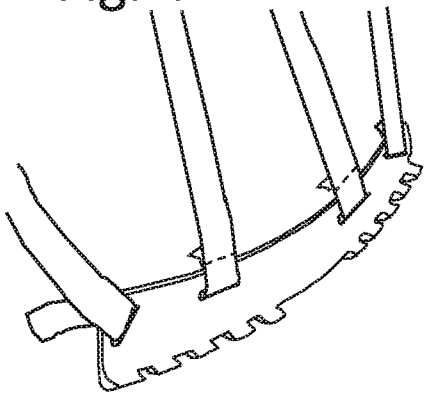
Fig. 45
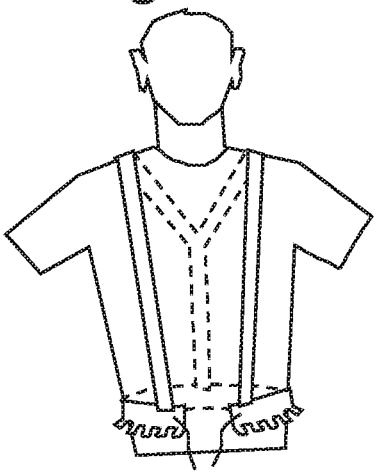
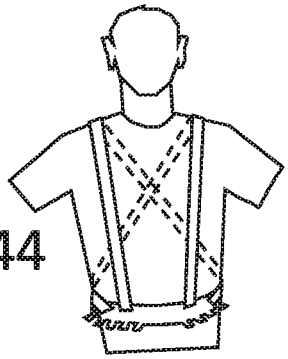
Fig. 44
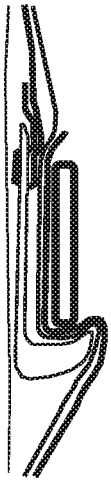
Fig. 43

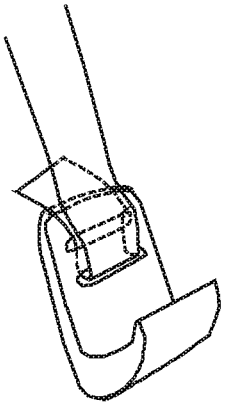
Fig. 46
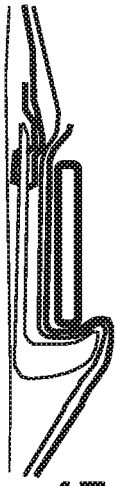
Fig. 47
Fig. 48
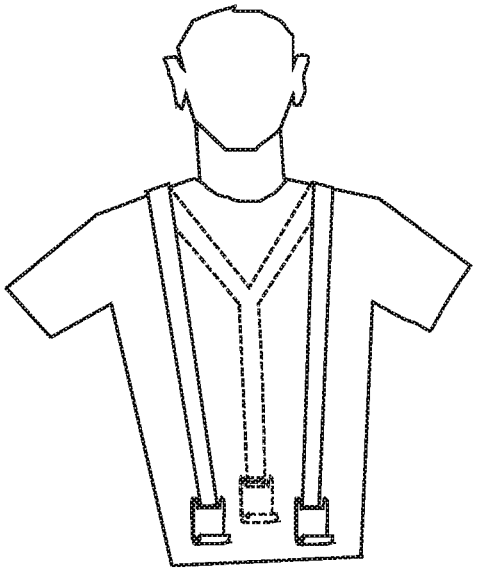
Fig. 49
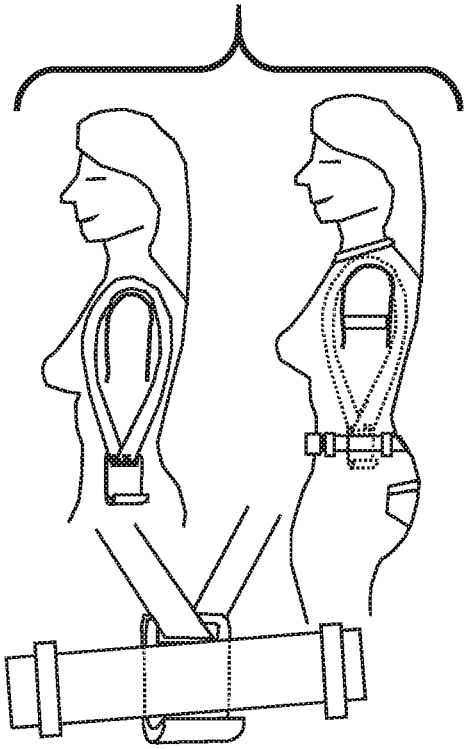
Fig. 50
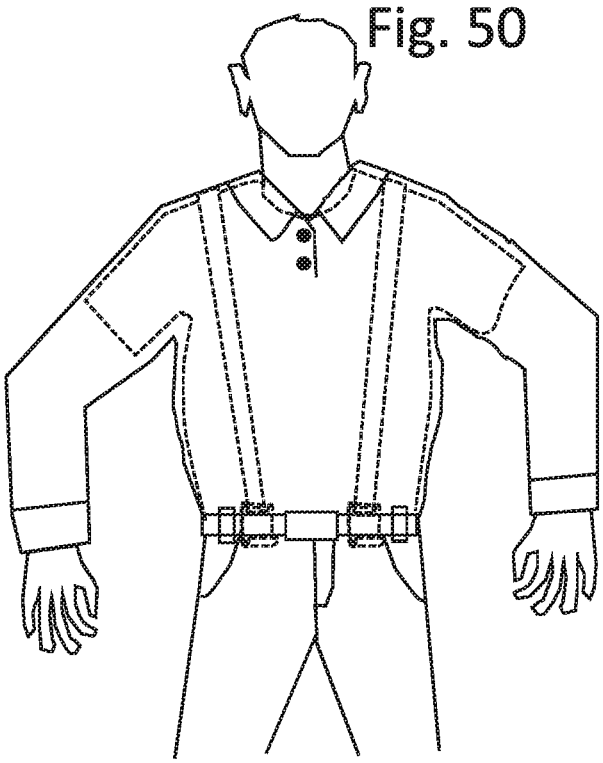

HIDDEN TROUSER SUSPENSION APPARATUS

CROSS REFERENCE TO RELATED APPLICATIONS

This application claims the benefit of and incorporates by reference Patent Cooperation Treaty patent application number PCT/US2019/31787 filed on May 10, 2019, which itself claimed the benefit of U.S. provisional patent application Ser. No. 62/669,982 filed May 10, 2018.

BACKGROUND OF THE INVENTION

Field of the Invention

This invention relates to a clothing accessories and, more particularly, to a concealed wearable device which assists in the positioning of trousers at a desired height relative to a wearer's waist.

Description of the Prior Art

The use and design of wearable items such as belts and suspenders to prevent the trousers (or pants) of a wearer from falling down is well established. Conventional belts, which are believed to date back to at least the Bronze Age, typically are structured to extend around the waist of a wearer and be tightened to a length that is less than the circumference of the hips of the wearer. In this way, when secured to the a wearer's trousers, they can hold them substantially in place. Conventional suspenders, however, are believed to be a much more recent introduction. Conventional suspenders are typically formed from elongated straps which are worn over a wearer's shoulders and attach at each end to the trousers of the wearer. Through this action, the trousers are "suspended" from the wearer's shoulders and thereby are prevented from sliding down the wearer.

Even with the presence of items such as belts and suspenders, it is well know that some individuals still have difficultly properly keeping their trousers in a desirable position while performing common activities and/or throughout the course of a day. While belts and suspenders both work against gravity, neither generally provides or includes any mechanism which may provide substantial leverage in the front and/or from beneath to do so. Furthermore, neither belts or suspenders offer much assistance in maintaining desirable relative positioning between a wearer's shirt and the wearer's trousers. And these issues which arise when wearing belts and suspenders only reflect a part of the challenge faced by those in need of assistance in holding up their pants as the ebb and flow of fashion trends may dictate to some that they cannot even wear a belt or suspenders when needed because belts and suspenders are substantially visible. So if they are out of style in some way, some users in need of assistance in holding up their pants may not be able to even the use of them.

Accordingly, what is needed is a trouser suspension apparatus which can be worn in a concealed manner and operate to assist in effectively holding up a wearer's trousers. It would be helpful for such a hidden trouser suspension apparatus to supply leverage to improve the ability of a wearer's pants to resist gravity and remain in position. It would additionally be desirable for such a hidden trouser suspension apparatus to be structured to also maintain a desirable relative positioning between a wearer's shirt and the wearer's trousers.

SUMMARY OF THE INVENTION

The present disclosure describes a hidden trouser suspension apparatus that includes a holder having a rigid portion formed of a substantially planar body that includes top end and a bottom end and an engager having a rigid, substantially planar body that includes a top engager end and a bottom engager end. The engager, when secured underneath a wearer's trousers behind a wearer's belt in the trousers, is structured to protrude into the inside surface of the trousers and provide a surface on which a belt looped in the trousers can rest. The top end and the top engager end together provide a positioning mechanism which may be defined by a hinge and the bottom end and the bottom engager end together provide a locking mechanism which may be defined as a latch. The holder and engager structured to be releasably fastened together with a front surface of the holder flush with a corresponding back surface of the engager through the operation of the positioning mechanism and the locking mechanism in a manner which fixes the holder and engager, when sandwiched around a portion of a shirt, in place on the shirt. The holder may include a padded portion which forms its back surface.

It is an object of this invention to provide a trouser suspension apparatus which can be worn in a concealed manner and operate to assist in effectively holding up a wearer's trousers.

It is another object of this invention to provide a hidden trouser suspension apparatus which supplies leverage to improve the ability of a wearer's pants to resist gravity and remain in position and the forces exerted by the shape of wearer's midsection on the front side of the pants.

It is yet another object of this invention to provide a hidden trouser suspension apparatus structured to also maintain a desirable relative positioning between a wearer's shirt and the wearer's trousers.

These and other objects will be apparent to one of skill in the art.

BRIEF DESCRIPTION OF THE DRAWINGS

FIGS. 16 through 31 show side elevational views of a cross-section of the engager of a hidden trouser suspension apparatus built in accordance with various alternate embodiments of the present invention.

FIG. 37 is a front perspective view of a hidden trouser suspension apparatus built in accordance with an alternate embodiment of the present invention.

FIG. 38 is a side elevational view of a hidden trouser suspension apparatus built in accordance with an alternate embodiment of the present invention shown installed in clothing.

FIG. 39 is a side elevational view of the engager of a hidden trouser suspension apparatus built in accordance with an alternate embodiment of the present invention.

FIG. 40 is a front elevational view of the engager of a hidden trouser suspension apparatus built in accordance with an alternate embodiment of the present invention and shown on a wearer.

FIG. 41 is a front elevational view of the engager of a hidden trouser suspension apparatus built in accordance with an alternate embodiment of the present invention and shown on a wearer.

FIG. 42 is a front perspective view of the engager of a hidden trouser suspension apparatus built in accordance with an alternate embodiment of the present invention and shown on a wearer.

FIG. 43 is a side elevational view of a hidden trouser suspension apparatus built in accordance with an alternate embodiment of the present invention shown installed in clothing.

FIG. 44 is a front perspective view of the engager of a hidden trouser suspension apparatus built in accordance with an alternate embodiment of the present invention and shown on a wearer.

FIG. 45 a front perspective view of the engager of a hidden trouser suspension apparatus built in accordance with an alternate embodiment of the present invention and shown on a wearer.

FIG. 46 is a front perspective view of the engager of a hidden trouser suspension apparatus built in accordance with an alternate embodiment of the present invention.

FIG. 47 is a side elevational view of a hidden trouser suspension apparatus built in accordance with an alternate embodiment of the present invention shown installed in clothing.

FIG. 48 is a front elevational view of the engager of a hidden trouser suspension apparatus built in accordance with an alternate embodiment of the present invention and shown on a wearer.

FIG. 49 is a side elevational view of the engager of a hidden trouser suspension apparatus built in accordance with an alternate embodiment of the present invention and shown on a wearer.

FIG. 50 is a front elevational view of the engager of a hidden trouser suspension apparatus built in accordance with an alternate embodiment of the present invention and shown on a wearer

DETAILED DESCRIPTION OF THE INVENTION

Figure 1:
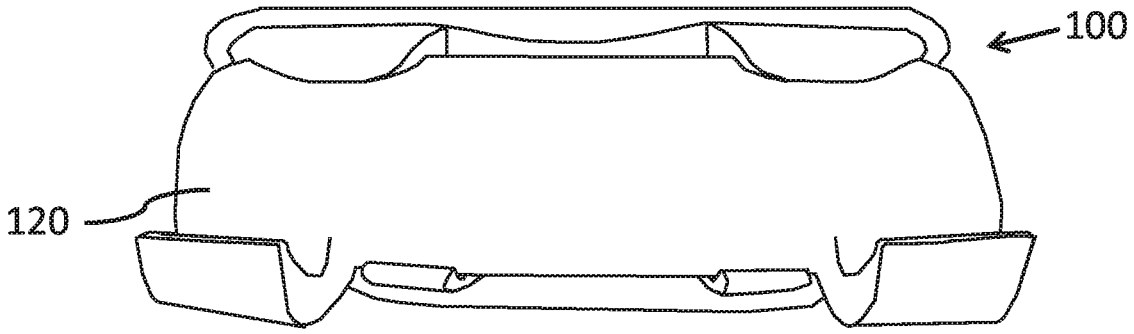
FIG. 1 is a front elevational view of a hidden trouser suspension apparatus built in accordance with the present invention.
Figure 2:
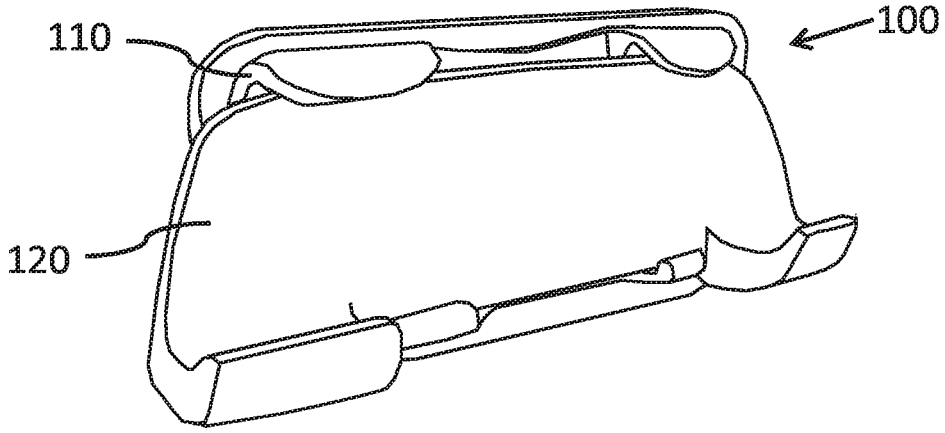
FIG. 2 is a front perspective view of a hidden trouser suspension apparatus built in accordance with the present invention.
Figure 3:
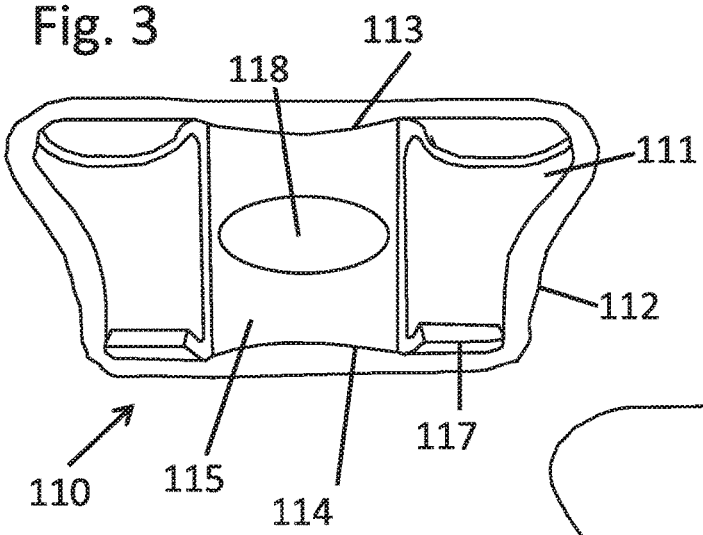
FIG. 3 is a front elevational view of the holder of a hidden trouser suspension apparatus built in accordance with the present invention.
Figure 4:
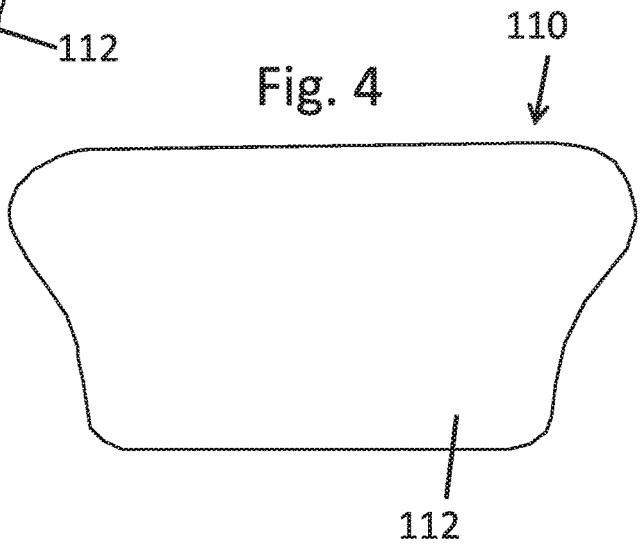
FIG. 4 is a rear elevational view of the holder of a hidden trouser suspension apparatus built in accordance with the present invention.
Figure 5:
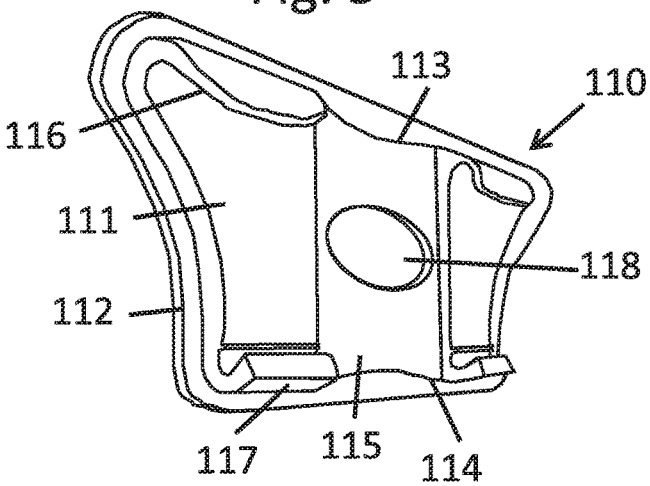
FIG. 5 is a side perspective view of the holder of a hidden trouser suspension apparatus built in accordance with the present invention.
Figure 6:
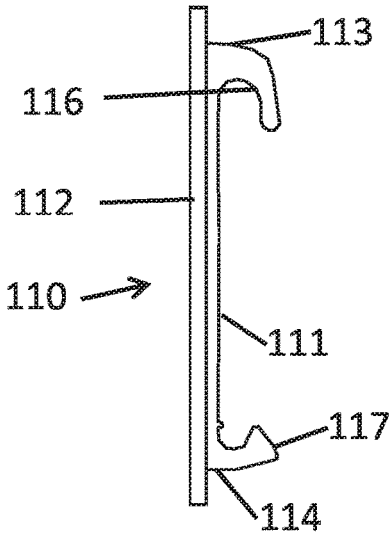
FIG. 6 is a side elevational view of the holder of a hidden trouser suspension apparatus built in accordance with the present invention.
Figure 7:
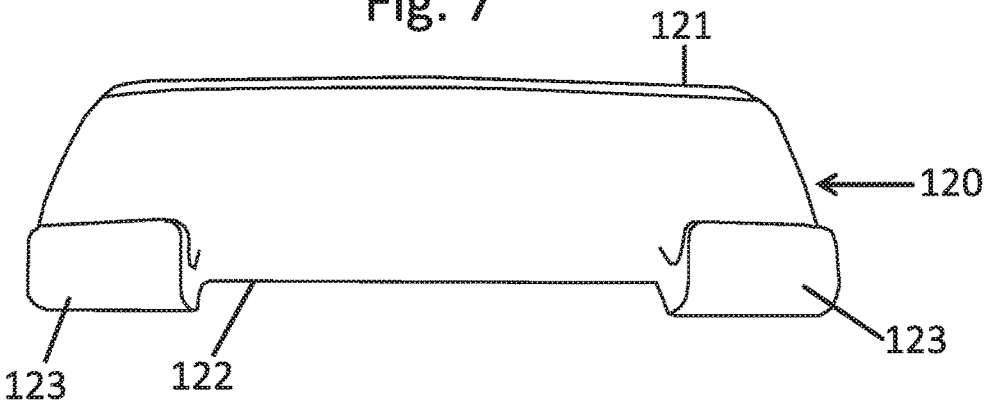
FIG. 7 is a front elevational view of the engager of a hidden trouser suspension apparatus built in accordance with the present invention.
Figure 9:
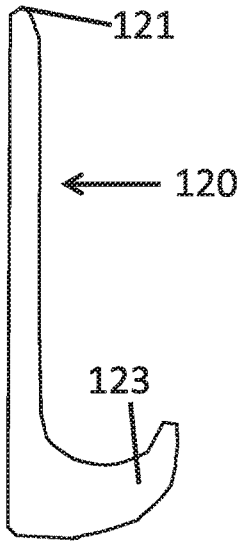
FIG. 9 is a side elevational view of the engager of a hidden trouser suspension apparatus built in accordance with the present invention.
Figure 8:
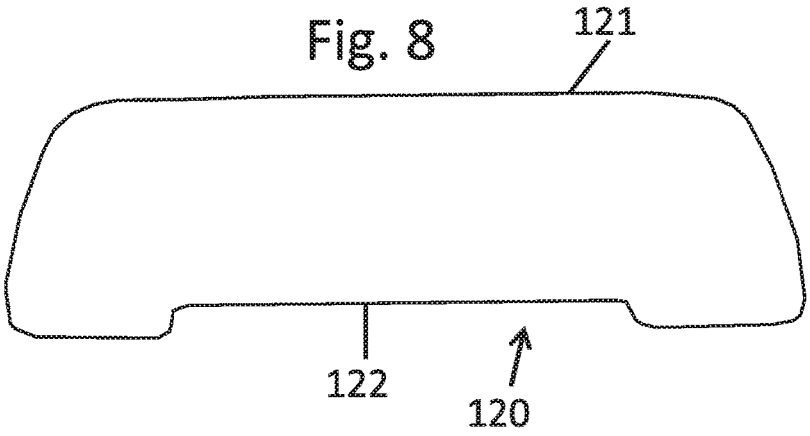
FIG. 8 is a rear elevational view of the engager of a hidden trouser suspension apparatus built in accordance with the present invention.
Figure 10:
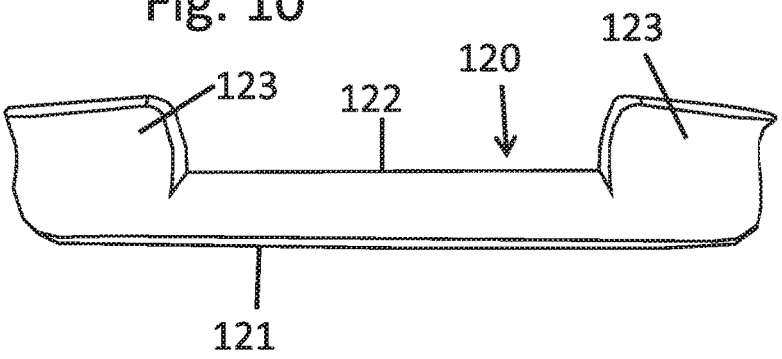
FIG. 10 is a side perspective view of the engager of a hidden trouser suspension apparatus built in accordance with the present invention.
Figure 12:
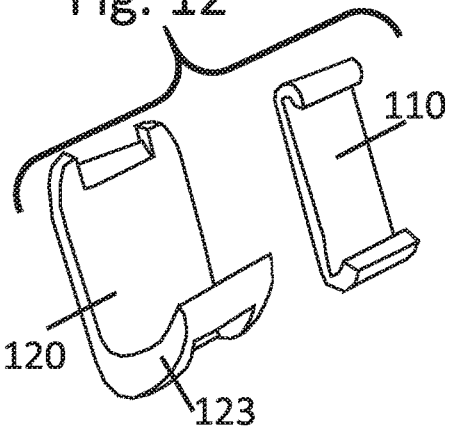
FIG. 12 is a side perspective view of a hidden trouser suspension apparatus built in accordance with an alternate embodiment of the present invention.

Described herein is a hidden trouser suspension apparatus which operates to assist in effectively holding up a wearer's trousers and maintaining the position of the wearer's trousers relative to the wearer's shirt. The hidden trouser suspension apparatus may be secured to the wearer's shirt and has an orthogonal support portion which may contact the interior of a wearer's trousers in a manner and location which acts against gravitational forces on the trousers. It is contemplated that the hidden trouser suspension apparatus may be employed by wearers who would like to wear a belt and suspenders without facing the societal stigma associated with wearing both belt and suspenders. This is accomplished because the hidden trouser suspension apparatus may direct attach, adhere to, or be frictionally affixed to a shirt or undershirt, thereby using the shirt or undershirt as an added supporting mechanism for the belt and the trousers instead of using the typical suspender bands as an added supporting mechanism.

Referring now to the drawings and in particular FIGS. 1, 2, 3, 4, 5, 6, 7, 8, 9, and 10, a hidden trouser suspension apparatus 100 is shown having two interlocking components, a holder 110 and an engager 120. As described below, the interlocking aspect of the holder 110 and the engager 120 provide the mechanism thought which the hidden trouser suspension apparatus 100 may be secured in place on a wearer's clothing for use.

The holder 110 has a substantially planar body and may include a rigid portion 111 and a padded portion 112. The rigid portion 111 has a top receiving end 113 forming its top edge, a bottom end 114 forming its bottom edge, and a middle depression 115 which runs vertically down a center area of the rigid portion. The top receiving end 113 may include two curved areas which extend outward from the front side of the rigid portion to form two elongated mating channels 116 which are separated by the middle depression 115 and extend across the top receiving end 113, facing towards the bottom end 114. The bottom end 114 may include or be defined by a latch 117 which extends outward from the front side of the rigid portion 111.

The rigid portion 111 may additionally include side edges which are curved inward.

The rigid portion 111 may further include a central aperture 118 which extends through the middle depression 115.

The padded portion 112 is fixed to the rear side of the rigid portion 111, opposite the front side of the rigid portion 111 where the curved areas of the top receiving end 113 and the latch 117 extend.

It is appreciated that the material which forms the rigid portion 111 is thinner at the middle depression 115 and that such thinning, along with the central aperture 118, may allow the rigid portion to slightly contour to the curves on a wearer's body, particularly if the rigid portion 111 is constructed out of a plastic material.

The engager 120 has a rigid, substantially planar body having a top engager end defined by a top mating edge 121 and a bottom engager end defined by a catch edge 122 and a pair of holder extensions 123, with the catch edge 122 flanked on either side by one of the holder extensions 123. The holder extensions 123 extend outwardly from the rest of the body of the engager 120 and are shaped to give the engager 120 a generally L-shaped or a J-shaped cross-section. In this regard, the holder extensions 123 configure the engager, when secured underneath a wearer's trousers, to abut or protrude into the inside surface of the trousers and provide a surface on which a wearer's belt can rest.

The top mating edge 121 is sized to slide into the elongated mating channels 116, allowing the top mating edge 121 and the elongated mating channels 116 to provide an upper positioning mechanism for the holder 110 and engager 120 which supports the interlocking aspect of the holder 110 and the engager 120. Similarly, the catch edge 122 is sized to be releasably secured in the latch 117, allowing the catch edge 122 and the latch 117 to provide a lower locking mechanism for the holder 110 and engager 120 which, along with the upper positioning mechanism, supports the interlocking aspect of the holder 110 and the engager 120. In this regard, the operation of the upper positioning mechanism and the lower locking mechanism configure the holder and engager to be releasably fastened together.

Figure 11:
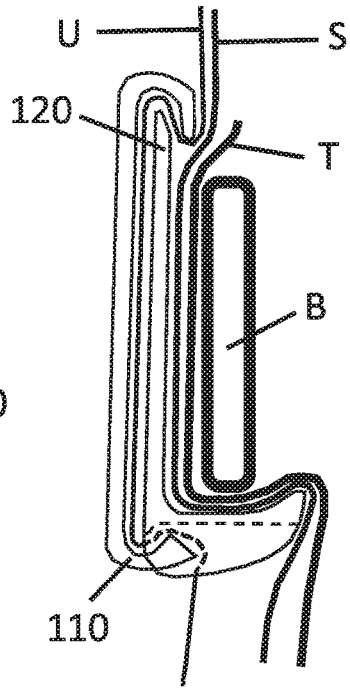
FIG. 11 is a side elevational view of a hidden trouser suspension apparatus built in accordance with the present invention shown installed in clothing.
Figure 14:
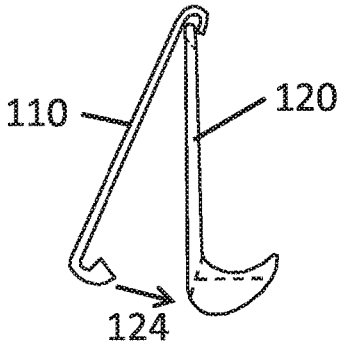
FIG. 14 is a side elevational view of a hidden trouser suspension apparatus built in accordance with an alternate embodiment of the present invention.

Referring now to FIG. 11, together, the holder 110 and the engager 120 form the hidden trouser suspension apparatus which provides for a combined suspender and shirt-staying apparatus which can to be worn preferably with a belt B and preferably under a wearer's tucked-in shirt S where it cannot be seen. Because it may be worn on an undershirt shirt U that is tucked into the trousers T, the hidden trouser suspension apparatus 100 provides both frictional resistance to a tucked-in outer shirt S against becoming untucked at and approximately around whichever section(s) of the waist the hidden trouser suspension apparatus. By way of the holder extensions, the hidden trouser suspension apparatus also provides a ledge which will maintain the position of an upper edge of the belt B. By protruding into the trousers T, the holder extensions 123 further provide increased friction on the inner side of trousers T on and approximately around whichever section(s) of the waist the hidden trouser suspension apparatus 100 is worn.

In use, the hidden trouser suspension apparatus may be employed by a wearer who is wearing trousers T and belt B, with the hidden trouser suspension apparatus installed approximately at the waist level of the wearer and attached or effectively attached to an undershirt U. The interlocking aspect of the holder 110 and the engager 120 enables the holder 110 and the engager 120, when interlocked, to be sandwiched around and compressed against the undershirt U so as to exhibit a sufficient frictional force on the undershirt U to fix the hidden trouser suspension apparatus in place, with the undershirt U bearing the weight of the holder 110, engager 120, the belt B and the trousers T, without the holder 110 and the engager 120 sliding down the undershirt U. This is done with the holder 110 and engager 120 remaining out of sight, underneath the trousers T, belt B, an outer shirt S, and the undershirt U. It is appreciated that by attaching the hidden trouser suspension apparatus to a wearer's undershirt U, a wearer may avoid local and/or non-uniform stretching (due to the weight supported) of their outer shirt S.

Nonetheless, it is contemplated that the hidden trouser suspension apparatus can similarly be attached to an outer shirt that is to be tucked in such that the outer shirt supports the weight of the holder, engager, the belt and the trousers, again without sliding down and with the holder and engager remaining substantially hidden under the trouser waistline.

Figure 13:
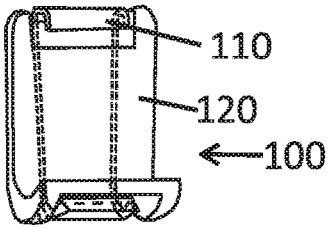
FIG. 13 is a front perspective view of a hidden trouser suspension apparatus built in accordance with an alternate embodiment of the present invention.

Referring now to FIGS. 1, 2, 3, 4, 5, 6, 7, 8, 9, 10, 12, 13, 14, 32, 33, 34, and 35, the interlocking aspect of the holder 110 and engager 120 allows these components to sandwich a shirt and bend the shirt between the holder 110 and engager 120, with a front surface of the holder 110 flush against a back surface of the engager 120. This configuration results in the shirt being frictionally secured between the holder 110 and engager 120. The interlocking aspect may operate by first engaging the upper positioning mechanism by inserting the top mating edge 121 into the elongated mating channels 116, as illustrated in FIG. 13, with the shirt lying in between the engager 120 and the holder 110, and then engaging the lower locking mechanism by swinging the free bottom end 114 (not yet mated), which features latch 117, in a locking direction 124 toward the bottom engager end, which includes the catch edge 122, and then pressing the catch edge 122 and the bottom end 114 together until the catch edge 122 engages and becomes locked into the latch 117. Through this action, the shirt is securely sandwiched between engager 120 and holder 110. To release the catch edge 122 from the latch 117, the latch may be pressed in the opposite direction until the catch edge 122 can swing out in a direction opposite the locking direction 124 and then the top mating edge 121 can be removed from the elongated mating channels 116.

The engager 120, as well as the rigid portion of the holder 110, may be constructed of molded or cast rubber, polymeric, or metallic material, or alternatively of wood or fiberglass or other materials or combinations thereof (such as a composite molded plastic with a metal mesh as internal reinforcement). It is contemplated that the engager's 120 cross-section is such that the vertical and preferably longest part of the cross-section is worn parallel to and approximately tangential to the skin of the waist of a wearer while the horizontal portion formed by the holder extensions 123 is positioned below the belt or below the belt-line and approximately perpendicular to the skin of waist of wearer. In this regard, the holder extensions 123 of the engager 120 can assist in carrying the weight of the belt and trousers from a position lower than the belt and the belt line (unlike belts and suspenders). The holder extensions 123 protrude out from the belly far enough to effectively undergird, hook, and/or keep the belt, belt buckle, and/or trouser waist from sliding downward with respect to the shirt while still being short enough to not create particularly noticeable bumps on the trousers just below the belt. The preferred length of the holder extensions 123, namely how far they extend from the front surface of the engager, is may be 0.5 inches. But it is contemplated that a length of between 0.125 inch and 1.5 inches may accomplish the objectives of this disclosure.

In various embodiments, the holder extensions may be shaped to give the engager an alternate cross-section such as a d shaped cross section or any similar to those shown in FIGS. 16-31.

Figure 15:
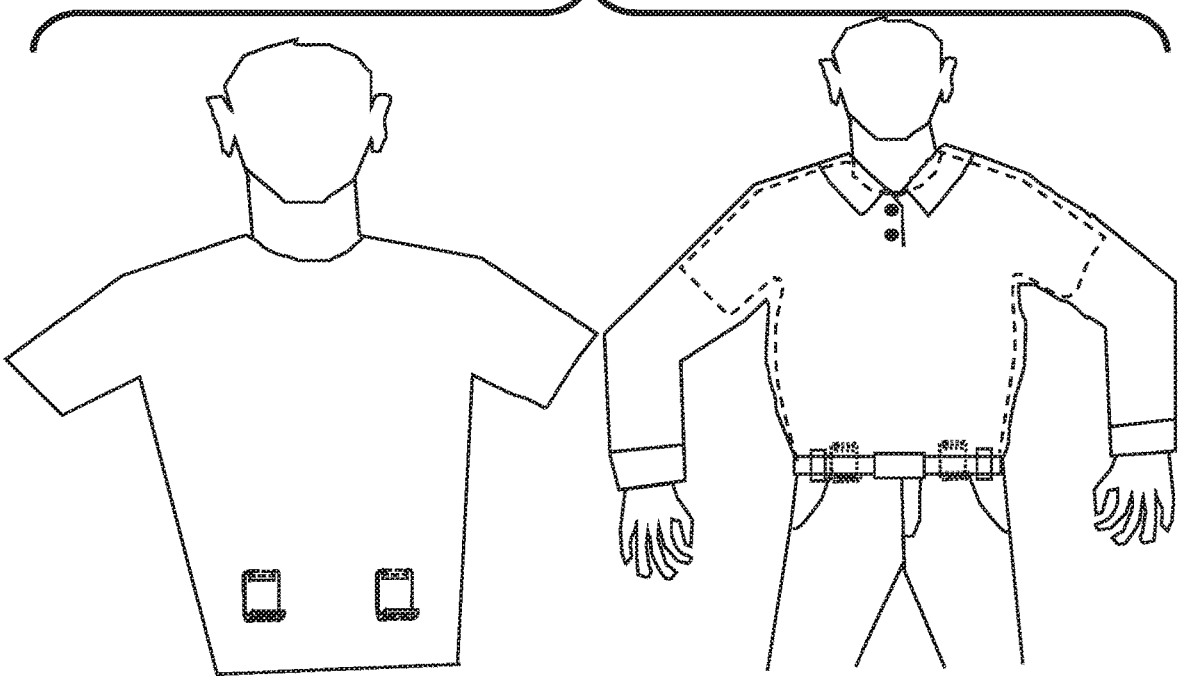
FIG. 15 is a front elevational view of a hidden trouser suspension apparatus built in accordance with an alternate embodiment of the present invention and shown on a wearer.
Figure 33:
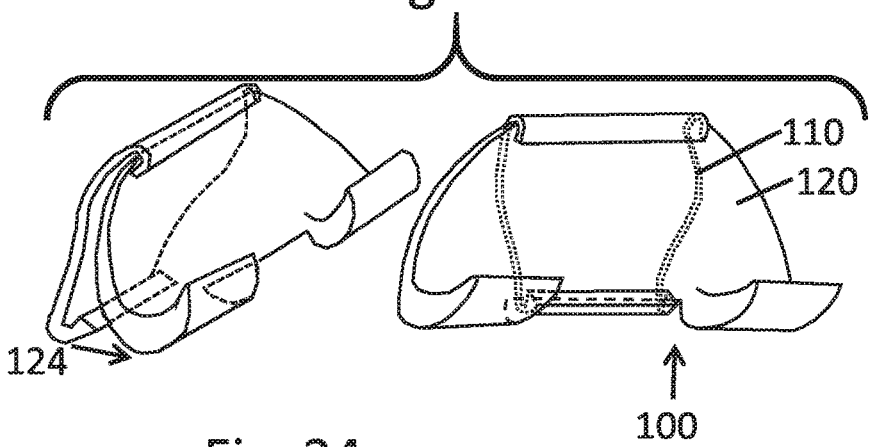
FIG. 33 is a front perspective view of a hidden trouser suspension apparatus built in accordance with an alternate embodiment of the present invention.
Figure 32:
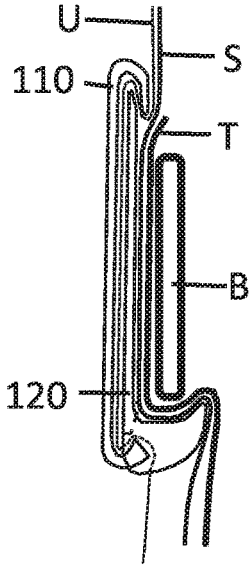
FIG. 32 is a side elevational view of a hidden trouser suspension apparatus built in accordance with an alternate embodiment of the present invention shown installed in clothing.
Figure 34:
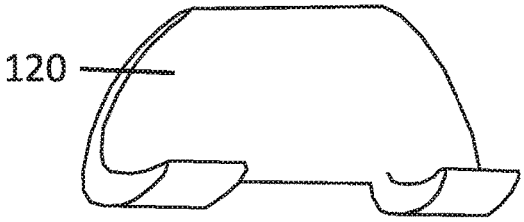
FIG. 34 is a front perspective view of the engager of a hidden trouser suspension apparatus built in accordance with an alternate embodiment of the present invention.
Figure 35:
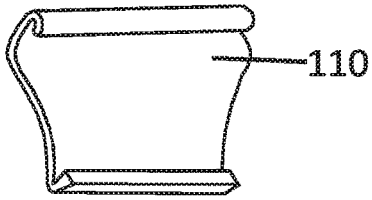
FIG. 35 is a side elevational view of the holder of a hidden trouser suspension apparatus built in accordance with an alternate embodiment of the present invention.
Figure 36:
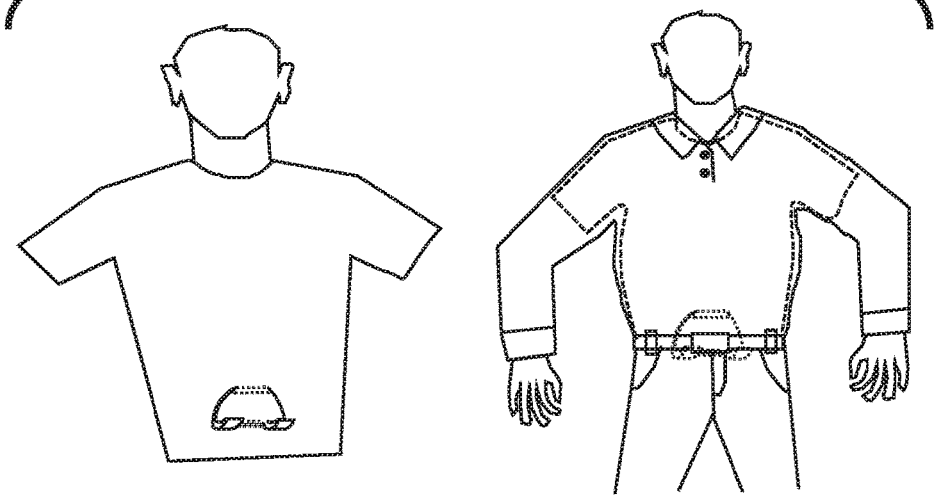
FIG. 36 is a front elevational view of a hidden trouser suspension apparatus built in accordance with an alternate embodiment of the present invention and shown on a wearer.

It is contemplated that the engager may cover a relatively small portion of the waistline (shorter than seven inches) at the front of the belly, such as is exemplified by FIGS. 15 and 36, while still providing optimal efficacy.

The hidden trouser suspension apparatus 100 can also have an alternative embodiment that wraps around and supports the entire waistline or the majority thereof such as is exemplified in FIG. 40. Alternatively, the hidden trouser suspension apparatus can have an alternative embodiment that wraps around a significant yet partial portion of the waistline (seven inches or greater), such as is exemplified by FIG. 39. Still in another alternative embodiment, multiple narrow engagers (less than 2.5 inches wide) are spaced from one another and support the trousers at a plurality of locations along the waistline, where such locations chosen and changeable by the user, such as is exemplified in FIGS. 15, 48, 50, and 52.

In the embodiments depicted FIGS. 42, 44, and 45, the holder extensions have a plurality of teeth with gaps between each other, such that these gaps facilitate the bending of said engager around the waistline to conform to the curve of the waist as required. Without said teeth or gaps, the engager would remain more rigid and, hence be more difficult to bend around the waist.

FIGS. 34, 42, 44, 45, and 51 all show engager embodiments that feature a gap between the holder extensions that surrounds the general areas where the belt buckle, zipper, and front trouser button are located in order to make room for and compensate for the additional bulk that stacks up at the front of the waistline due to the zipper, belt buckle, front trousers button, and waist fabric overlap in the button and zipper area. Such a gap keeps the stack-up and said additional bulk from protruding as far out from the belly as would occur in the absence of said gap, and therefore, the gap conceals the presence of the underlying engager more effectively than not having a gap would because said gap allows the existing bulk to occupy much of the recessed area of the engager found at said gap.

For additional shirt-staying effectiveness the engagers exemplified in FIGS. 12, 34, 37, 42, 44, 45, 46, and 51 can alternatively have an enhanced distal surface (contacting the outer shirt). The enhanced distal surface may be rubber-coated, coated by adhesive layer, or features a rough or spiked texture which makes contact with the outer shirt and prevents sliding of the shirt with respect to the engager while under the force exerted by the belt or an otherwise tight waistline of the trousers where. The enhanced distal surface is exemplified in the cross-sections shown in FIGS. 28, 29, and 31.

In some embodiments, the hidden trouser suspension apparatus may be further enhanced for added comfort by adding a radius or a bevel to all corners and edges of the engager and/or holder that might exert direct or indirect pressure on the skin of the user. For simplicity of drawings, many opportunities for beveling or rounding off corners and edges for added comfort were left undrawn. All such rounding or beveling of corners and edges can either be incorporated by design into the mold or casting or can be achieved by material removal processes such sanding, filing, scraping, deburring, and machining to be done after the engager and/or holder is molded or cast and sufficiently cured if applicable to the material being used An alternative embodiment shown in FIGS. 37 and 38 uses a slideably interlocking holder and engager assembly, and it alternatively features a latch feature on the holder and a corresponding receiver feature on the receiver, or vice-versa. FIG. 37 provides an example of said sliding and latching features and the direction of said interlocking sliding motion. FIGS. 37 and 38 show approximately parallel male features on the top and bottom proximal ends of the engager and a corresponding and parallel female features on the top and bottom ends of the holder on FIG. 37 which allow for the slideable mating and interlocking of the engager and the holder with the shirt captured between the two.

An alternative embodiment shown in FIGS. 37 and 38 uses a slideably interlocking holder and engager assembly, and it alternatively features a latch feature on the holder and a corresponding receiver feature on the receiver, or vice-versa. FIG. 37 exemplifies the sliding and latching features and the direction of said interlocking sliding motion. FIGS. 37 and 38 show approximately parallel male features on the top and bottom proximal ends of the engager and a corresponding and parallel female features on the top and bottom ends of the holder which allow for the slideable mating and interlocking of the engager and the holder with the shirt captured between the two.

Yet another similar slidable interlocking alterative embodiment would conversely have male features on the holder and female features on the engager with an engager cross-section similar to that shown in FIG. 27 and a rectangular holder cross-section that would snugly fit within the top and bottom female features of the engager cross-section show in FIG. 27 while allowing some predetermined clearance for the shirt to be compressed between said engager and holder.

It is contemplated that in an embodiment, the engager may be secured to an undershirt through the use of an a fastener, such as a portion of fabric hook and loop fastener material or an adhesive. Indeed, this disclosure also contemplates other possible means of attachment of, or adhering of said engager to undershirt or possible means of generating static friction between the engager and the undershirt and/or effectively attaching the engager to the undershirt, and the following are examples, though not necessarily an all-encompassing list, of said other possible means of said attachment, said adhesion, or said generation of static friction: (1) using velcro attached to the shirt and engager to allow removable attachment of engager onto shirt; (2) the incorporation of a magnet or ferrous metal on the engager with a corresponding magnet or metal plate used on the shirt in order to sandwich and possibly bend the shirt between the two metals and/or magnets that are attracted to each other, thereby creating friction between the shirt and the engager to prevent slipping; (3) sewing engager onto shirt; (4) gluing or otherwise adhering engager onto shirt; (5) adding to the engager a rubber-coated or rubber or spiky or adhesive or sticky back side (Such as seen in FIGS. 28 through 31) that adheres to shirt, pierces the shirt, and/or exerts a large amount of friction on the shirt to prevent sliding of engager with respect to the shirt while engager and shirt are under pressure added by tension of the belt and/or trouser waistline; (6) attaching the engager to a belt or band worn under a shirt, where said belt or band wraps around the waist and is made of a rubber, fabric, or otherwise adhesive or high-friction material which adheres to the undershirt or skin or exerts a sufficiently high amount of frictional force on the undershirt or skin when wrapped around waist under predetermined amount of tension; and (7) the engager (1) being attached to one or more clips (11) which can clip onto the undershirt, as shown in FIGS. 39 through 41.

Referring now to FIGS. 42-56, in another embodiment, the hidden trouser suspension apparatus allows for the use of actual suspender bands. In such embodiments, the hidden trouser suspension apparatus rely on suspenders to support the engager(s) where the engagers have narrow holes (or slots) in predetermined locations of the engager where said slots receive the ends of the suspenders thereby allowing the suspenders to be slipped through said slots to facilitate attachment of the suspenders onto the engager. Such embodiments may allow for adjustability of active (or load-bearing) suspender end lengths by providing two or more slots through which each adjustable inactive (or non-load-bearing) suspender end length can be slipped, pulled, and held constant via friction generated as a result of the looping configuration of said suspender end such that suspender end exerts frictional force against the corner edges of said slots and/or against other parts of the suspender ends themselves while in the worn position. This leaves the user with a constant desired active length of the suspender that he/she can adjust at any time by pulling more or less length of the suspender end through said slots (12) on engager.

There are other embodiments that would allow adjusting of the active suspender length such as would utilize fabric hook and loop fasteners, knots, safety pins or clips at the suspender ends. The ends of the suspenders can also be alternatively sewn in locations where active length adjustability might not be desirable and/or essential, and gluing would also be an alternative to sewing.

Figure 51:
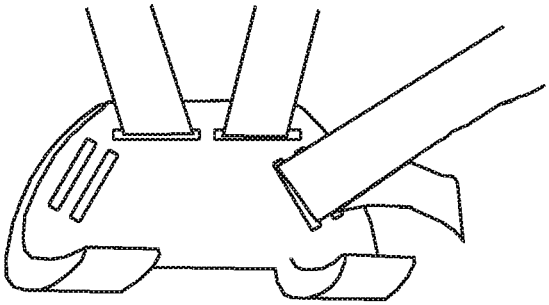
FIG. 51 is a front perspective view of the engager of a hidden trouser suspension apparatus built in accordance with an alternate embodiment of the present invention.
Figure 52:
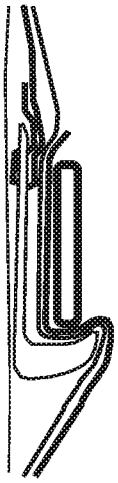
FIG. 52 is a side elevational view of a hidden trouser suspension apparatus built in accordance with an alternate embodiment of the present invention shown installed in clothing.
Figure 54:
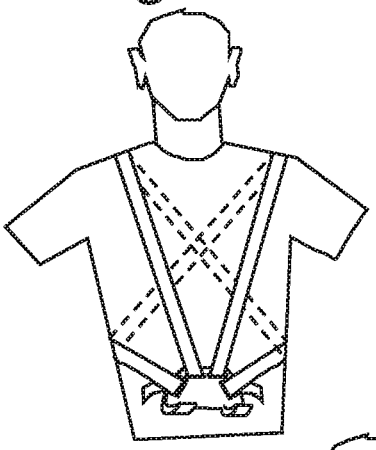
FIG. 54 is a front elevational view of the engager of a hidden trouser suspension apparatus built in accordance with an alternate embodiment of the present invention and shown on a wearer.
Figure 55:
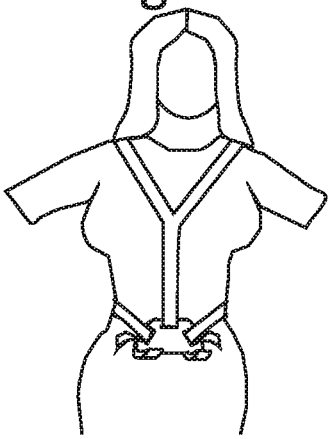
FIG. 55 is a front elevational view of the engager of a hidden trouser suspension apparatus built in accordance with an alternate embodiment of the present invention and shown on a wearer.
Figure 53:
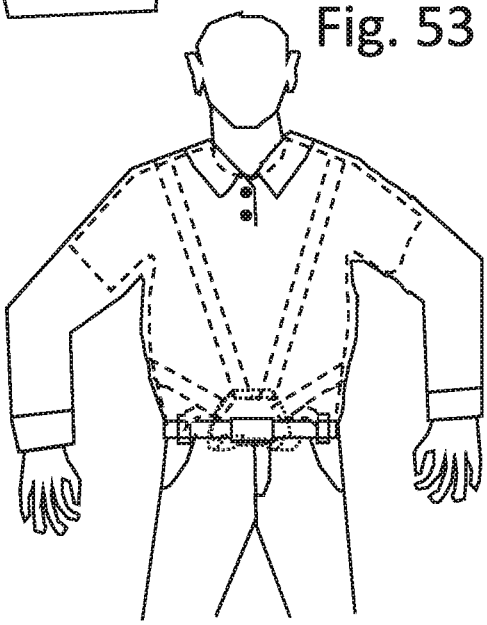
FIG. 53 is a front elevational view of the engager of a hidden trouser suspension apparatus built in accordance with an alternate embodiment of the present invention and shown on a wearer.
Figure 56:
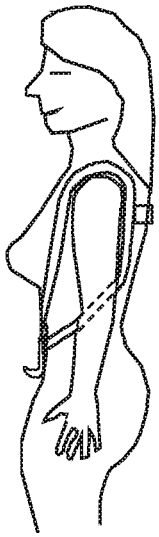
FIG. 56 is a side elevational view of the engager of a hidden trouser suspension apparatus built in accordance with an alternate embodiment of the present invention and shown on a wearer.

FIGS. 48 and 50 show a traditional suspenders configuration used in conjunction with said engager. FIG. 49 shows an alternative suspenders configuration preferable for women or men wherein the suspenders do not run directly over the chest and, instead, support the pants closer to the sides of the waist. FIGS. 51, 53, and 54 show an engager embodiment and corresponding suspenders configuration that suspend mainly the front of the waist preferably in men, whereas FIGS. 55 and 56 show an engager and suspenders configuration that may be preferable for women because the suspenders avoids going over the breasts but rather go in between the breast in order to support the engager, which, in turn, supports the trousers at front center of the waist.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hidden trouser suspension apparatus, comprising:

a holder having a rigid portion formed of a body that includes a top end, a bottom end, and a front surface;

an engager having a rigid body that includes a top engager end, a bottom engager end, and a back surface, wherein said engager is a discrete component that is separable from the holder and is configured to, when secured underneath a wearer's trousers behind a wearer's belt in the trousers, protrude into an inside surface of the trousers and provide an object on which a belt can rest; and wherein said top end and said top engager end together provide at least one of a first positioning mechanism and a first locking mechanism, said bottom end and bottom engager end together provide at least one of a second positioning mechanism and a second locking mechanism, and the holder and engager are configured to be releasably fastened together with the front surface of the holder facing the back surface of the engager through the operation of at least one of the first positioning mechanism, first locking mechanism, second positioning mechanism, and second locking mechanism in a manner which fixes the holder and engager, when sandwiched around a piece of fabric, in place on the fabric.

2. The hidden trouser suspension apparatus of claim 1, wherein said holder includes a padded portion integral with said rigid portion and disposed on an opposite side of the holder from the front surface of the holder.

3. The hidden trouser suspension apparatus of claim 2, wherein said padded portion is sized to extend outwardly beyond the top end to the bottom end.

4. The hidden trouser suspension apparatus of claim 1, wherein said rigid portion includes a middle depression which extends from the top end to the bottom end.

5. The hidden trouser suspension apparatus of claim 4, wherein said rigid portion includes a central aperture passing through the middle depression.

6. The hidden trouser suspension apparatus of claim 1, wherein:

said top end and said top engager end together provide the first positioning mechanism; and said top end includes at least one elongated mating channel, said top engager end includes a top mating edge, and said at least one elongated mating channel and said top mating edge together define the first positioning mechanism.

7. The hidden trouser suspension apparatus of claim 6, wherein:

said bottom end and said bottom engager end together provide the second locking mechanism; and said bottom end includes a latch, said bottom engager end includes a catch edge, and said bottom end and said bottom engager end together define the second locking mechanism.

8. The hidden trouser suspension apparatus of claim 1, wherein:

said bottom end and said bottom engager end together provide the second locking mechanism; and said bottom end includes a latch, said bottom engager end includes a catch edge, and said bottom end and said bottom engager end together define the second locking mechanism.

9. A hidden trouser suspension apparatus, comprising:

a holder having a rigid portion formed of a body that includes a top end, a bottom end, and a front surface, wherein said rigid portion includes a middle depression which extends vertically in the rigid portion towards both the top end and the bottom end;

an engager having a rigid body that includes a top engager end, a bottom engager end, and a back surface, wherein said engager is a discrete component that is separable from the holder, said engager includes at least one holder extension which extends outwardly from the body and said at least one holder extension, when the engager is secured underneath a wearer's trousers behind a wearer's belt in the trousers, is configured to protrude into an inside surface of the trousers and provide an object on which a belt can rest;

wherein said top end and said top engager end together provide at least one of a first positioning mechanism and a first locking mechanism, said bottom end and bottom engager end together provide at least one of a second positioning mechanism and a second locking mechanism, and the holder and engager are configured to be releasably fastened together with the front surface of the holder facing the back surface of the engager through the operation of at least one of the first positioning mechanism, first locking mechanism, second positioning mechanism, and second locking mechanism in a manner which fixes the holder and engager, when sandwiched around a piece of fabric, in place on the fabric.

10. The hidden trouser suspension apparatus of claim 9, wherein:

said top end and said top engager end together provide the first positioning mechanism; and said top end includes at least one elongated mating channel, said top engager end includes a top mating edge, and said at least one elongated mating channel and said top mating edge together define the first positioning mechanism.

11. The hidden trouser suspension apparatus of claim 10, wherein:

said bottom end and said bottom engager end together provide the second locking mechanism; and said bottom end includes a latch, said bottom engager end includes a catch edge, and said bottom end and said bottom engager end together define the second locking mechanism.

12. The hidden trouser suspension apparatus of claim 9, wherein:

said bottom end and said bottom engager end together provide the second locking mechanism; and said bottom end includes a latch, said bottom engager end includes a catch edge, and said bottom end and said bottom engager end together define the second locking mechanism.

13. The hidden trouser suspension apparatus of claim 9, wherein said holder includes a padded portion integral with said rigid portion and disposed on an opposite side of the holder from the front surface of the holder.

14. The hidden trouser suspension apparatus of claim 13, wherein said padded portion is sized to extend outwardly beyond the top end to the bottom end.

15. The hidden trouser suspension apparatus of claim 9, wherein said middle depression which extends from the top end to the bottom end.

16. The hidden trouser suspension apparatus of claim 15, wherein said rigid portion includes a central aperture passing through the middle depression.

17. A hidden trouser suspension apparatus, comprising:

a holder having a rigid portion formed of a body that includes a top end, a bottom end, and a front surface and a padded portion integral with said rigid portion and disposed on an opposite side of the holder from the front surface of the holder, wherein said rigid portion includes a middle depression which extends vertically in the rigid portion towards both the top end and the bottom end;

an engager having a rigid body that includes a top engager end, a bottom engager end, and a back surface, wherein said engager is a discrete component that is separable from the holder, said engager includes at least one holder extension which extends outwardly from the body and said at least one holder extension, when the engager is secured underneath a wearer's trousers behind a wearer's belt in the trousers, is configured to protrude into an inside surface of the trousers and provide an object on which a belt can rest; and wherein said holder and engager are configured to be releasably fastened together with the front surface of the holder facing the back surface of the engager in a manner which fixes the holder and engager, when sandwiched around a piece of fabric, in place on the fabric.

18. The hidden trouser suspension apparatus of claim 17, wherein said padded portion is sized to extend outwardly beyond the top end to the bottom end.

19. The hidden trouser suspension apparatus of claim 18, wherein said middle depression extends from the top end to the bottom end of the rigid portion and said rigid portion includes a central aperture passing through the middle depression.

20. The hidden trouser suspension apparatus of claim 17, wherein said middle depression extends from the top end to the bottom end of the rigid portion and said rigid portion includes a central aperture passing through the middle depression.

* * * * *